US006453816B2

(12) United States Patent
Redecker et al.

(10) Patent No.: US 6,453,816 B2
(45) Date of Patent: Sep. 24, 2002

(54) TEMPERATURE FUSE WITH LOWER DETONATION POINT

(75) Inventors: Klaus Redecker, Nuremberg; Waldemar Weuter; Ulrich Bley, both of Fuerth; Dagmar Schmittner, Erlangen, all of (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/835,358

(22) Filed: Apr. 17, 2001

Related U.S. Application Data

(63) Continuation of application No. 09/269,018, filed as application No. PCT/EP97/03836 on Jul. 17, 1997, now abandoned.

(30) Foreign Application Priority Data

Jul. 20, 1996 (DE) ..... 196 29 227
Nov. 26, 1996 (DE) ..... 196 48 809

(51) Int. Cl.[7] ..... F92C 19/08
(52) U.S. Cl. ..... 102/288; 102/289; 149/36; 149/38
(58) Field of Search ..... 102/288, 289; 149/22, 38, 36

(56) References Cited

U.S. PATENT DOCUMENTS

| | | | | |
|---|---|---|---|---|
| 5,084,118 A | | 1/1992 | Poole | 149/22 |
| 5,380,380 A | | 1/1995 | Poole et al. | 149/22 |
| 5,431,103 A | * | 7/1995 | Hock et al. | 102/289 |
| 5,536,339 A | | 7/1996 | Verneker | 149/195 |
| 5,623,116 A | * | 4/1997 | Hamilton et al. | 102/289 X |
| 5,670,740 A | * | 9/1997 | Barnes et al. | 102/289 X |
| 5,670,790 A | | 9/1997 | Barnes et al. | 102/277 X |
| 5,739,460 A | | 4/1998 | Knowlton et al. | 102/324 |
| 5,739,760 A | * | 4/1998 | Knowlton et al. | 102/324 |
| 5,861,571 A | * | 1/1999 | Scheffee et al. | 102/289 X |
| 6,039,820 A | * | 3/2000 | Hinshaw et al. | 102/289 X |
| 6,101,947 A | * | 8/2000 | Knowlton et al. | 102/289 X |
| 6,177,028 B1 | * | 1/2001 | Kanda et al. | 102/289 X |

FOREIGN PATENT DOCUMENTS

| | | |
|---|---|---|
| DE | 43 01 794 C | 5/1994 |
| DE | 195 48 544 A | 6/1997 |
| EP | 0 589 042 A | 3/1994 |
| EP | 0 595 668 A | 5/1994 |
| EP | 0 659 715 A | 6/1995 |
| EP | 0 665 138 A | 8/1995 |
| GB | 801 015 A | 9/1958 |
| WO | 94 14637 A | 7/1994 |
| WO | 95 26945 A | 10/1995 |

* cited by examiner

*Primary Examiner*—Peter A. Nelson
(74) *Attorney, Agent, or Firm*—Antonelli, Terry, Stout & Kraus, LLP

(57) ABSTRACT

A temperature fuse for gas-generating mixtures consists of substances or mixtures of substances that have lower detonation points or decomposition points than the gas-generating mixture. In particular, the temperature fuse contains substances or mixtures of substances that thermally decompose exothermically in a narrowly restricted temperature range. The evolution of heat that results ignites the gas-generating mixture.

21 Claims, No Drawings

TEMPERATURE FUSE WITH LOWER DETONATION POINT

CROSS REFERENCE TO RELATED APPLICATION

This application is a continuation of U.S. Ser. No. 09/269,018, filed Mar. 17, 1999, now abandoned which is a 371 of PCT/EP97/03836.

The subject-matter of the present invention is temperature fuses which can be used, for example, in gas generators for motor vehicle safety systems.

Gas-generating mixtures used in gas generators for motor vehicle safety systems are, as a rule, thermally very stable. In order to ignite the gas-generating mixture in a controlled manner at high ambient temperature, for example in the case of a vehicle fire, so-called temperature fuses are used. Such a fuse is necessary in order to prevent the gas-generating mixture self-igniting in an uncontrolled manner at unusually high temperatures. Namely, at high temperatures, the gas-generating mixture would not burn normally, but because of the increased temperature would react in a correspondingly accelerated and violent manner, in unfavourable cases explosively. The generator housing is not designed for this accelerated, violent reaction and would thereby be destroyed. A considerable risk to the motor vehicle passengers would be the result. The temperature fuse ensures that the reaction of the gas-generating mixture is thermally triggered well below this critical temperature. As a result of its early reaction and controlled ignition of the gas-generating mixture in such a case, it prevents the destruction of the generator housing and the dangers linked therewith.

In the prior art, nitrocellulose, or propellent charge powder derived therefrom, are generally used as a temperature fuse. A crucial disadvantage of nitrocellulose, however, is that it already begins to decompose slowly at temperatures which are still not sufficient for ignition. In the extreme case, the nitrocellulose decomposes completely. It can then no longer fulfil its task as a temperature fuse. Attempts have admittedly been made to improve the thermal stability of nitrocellulose. These attempts, however, are subject to narrow restrictions.

An object of the present invention has therefore been to provide a temperature fuse which does not have the disadvantages of the nitrocellulose-based temperature fuse.

The underlying object of the invention was achieved by a temperature fuse having the characterizing features of the main claim. Advantageous developments are characterized in the subclaims.

Surprisingly, it has been established that the temperature fuses in accordance with the invention are able to ignite thermally the gas-generating mixtures normally used in gas generators in a controlled manner well below the critical temperature.

Substances or mixtures of substances which have lower detonation points or decomposition points than the actual gas-generating mixture can be used as temperature fuses in accordance with the invention. The absolute level of the detonation points or decomposition points of the temperature fuses in accordance with the invention thereby depends on the respective construction and housing stability of the gas generator which is used. The more stable the generator housing, for example, the higher in general these values can be for the temperature fuse in accordance with the invention.

Substances or mixtures of substances, the exothermal thermal decomposition of which takes place in a narrowly restricted temperature range, can be used for the temperature fuses in accordance with the invention. The evolution of heat which occurs must, in this case, be sufficient to compensate for energy losses in the gas-generating mixture, in order to achieve, or exceed, the activation energy needed to ignite the gas-generating mixture.

Compounds selected from the compound classes of oxalates, peroxidisulphates (persulphates), permanganates, nitrides, perborates, bismuthates, formates, nitrates, sulphamates, bromates or peroxides can be used as substances or mixtures of substances for the temperature fuses in accordance with the invention. As oxalates, there can preferably be used iron(II)oxalate dihydrate which has a distinct decomposition point at 190° C., ammonium-iron-(III)-oxalate, the double salt of ammonium oxalate and iron oxalate with decomposition temperatures of 160–170° C.; as peroxidisulphates (persulphates) preferably ammonium persulphate, sodium persulphate or potassium persulphate, the thermal decomposition of which is suitable for starting the reaction; as permanganates preferably sodium permanganate or potassium permanganate; as formates preferably ammonium formate or calcium formate; as a nitrate preferably ammonium nitrate; as a sulphamate preferably ammonium sulphamate; as a nitride preferably iron nitride, as a bismuthate preferably sodium bismuthate; as a bromate preferably potassium bromate, and as a peroxide preferably zinc peroxide. Iron oxide and/or ferrocene, can also be used. Apart from this, oxidizable components, for example explosives having low detonation or decomposition points, preferably calcium bistetrazolamine, 3-nitro-1,2,4-triazol-5-one (NTO), 5-aminotetrazole nitrate, nitroguanidine (NIGU), guanidine nitrate and bistetrazolamine, can be used. The substances can be used individually or in a mixture. A specific thermal decomposition point of the temperature fuse in accordance with the invention can be adjusted by adjusting the mixture.

Of these substances, those which have a lower detonation point or decomposition point than the gas-generating mixture which is used and thereby decompose exothermally can be used alone, without addition of a fuel, for example, as a temperature fuse in accordance with the invention. The substances which have a lower detonation point or decomposition point than the gas-generating mixture which is used but thereby decompose endothermally require at least one fuel and possibly a reducing agent in order to be able to be used as a temperature fuse in accordance with the invention. For example, the known explosives preferably calcium bistetrazolamine, 3-nitro-1,2,4-triazol-5-one (NTO), 5-aminotetrazole nitrate, nitroguanidine (NIGU), guanidine nitrate and bistetrazole amine can be used as fuels, and metal powder, preferably titanium powder, can be used as a reducing agent, for example.

When the explosives are used as a temperature fuse in accordance with the invention, having lower detonation or decomposition points than the gas-generating mixture which is used, then, in addition to the substances already mentioned above, guanidine nitrate, or even oxidizing agents such as potassium nitrate, sodium nitrate, strontium nitrate, potassium perchlorate or mixtures of these oxidizing agents, can be added in order to influence the detonation points and thus the range of effectiveness of the temperature fuse in accordance with the invention.

The temperature fuses in accordance with the invention can be used in a variety of ways. One use provides using them homogeneously in the gas-generating mixture. In particular, the temperature fuses in accordance with the invention that do not impair or impair only to an insignificant extent the actual characteristic of the gas-generating mixture are suitable herefor. The homogeneous distribution can take place according to mixing methods which are known per se, for example by sieving or tumbling the dry mixture or by kneading, extruding or extrusion moulding a moistened or solvent-containing mixture. The addition of a binding agent is likewise possible. In the case of this use, the temperature fuses in accordance with the invention can constitute 0.1 to 20% by weight, preferably 0.1 to 5 by weight, of the gas-generating mixture.

A further use provides for the temperature fuses in accordance with the invention in the generator housing to be separated from the actual gas-generating mixture. This use is always to be recommended if the temperature fuses in accordance with the invention that are used impair the actual characteristic of the gas-generating mixture. In the case of this use, these temperature fuses in accordance with the invention are preferably provided at thermally exposed points on the generator housing. In this way, a reliable triggering of the temperature fuse in the case of heating from the outside is ensured, as a result of which the controlled ignition of the gas-generating mixture is ensured. In the case of this use, the admixtures in accordance with the invention can be used in the form of tablets, for example. The production of such tablets takes place according to methods which are known per se.

A further use provides including the temperature fuses in accordance with the invention in the normal ignition device of the gas-generating mixture. In this case, two variants can be used: the temperature fuses in accordance with the invention are distributed homogeneously in the ignition mixture or are separated therefrom, for example in the form of a tablet.

In all applications, the purity of the substances which are used determines the instant of thermal triggering and the grain size determines the energy which is released locally. For improved processing of the temperature fuses in accordance with the invention, processing aids which are known per se, for example talc, graphite or boron nitride, can be used.

In addition to their use in safety systems, the temperature fuses in accordance with the invention can also be used, for example, in pressure or safety elements for triggering movements of mechanical elements.

The temperature fuses in accordance with the invention are compatible with the gas-generating mixture and its components and show, in accordance with the requirements, a temperature and storage stability that is sufficient for the instance of application and considerably improved in comparison with nitrocellulose. The problem of slow decomposition at comparatively high storage temperatures, which is to be noticed in the case of nitrocellulose, is not displayed by the temperature fuses in accordance with the invention. A thermal change at the required storage and operating temperatures could not be established.

The requirement for the substances used to be toxicologically safe is likewise fulfilled, as is the requirement for the gases and reaction products of the gas-generating mixture, which can be used when blowing up an air bag, for example, to be toxicologically safe; there is no need to fear the motor vehicle passengers being put at risk or harmed.

The disposal of the gas-generating mixture with the temperature fuses in accordance with the invention is also safe; it is ensured with simple means and without expensive installations.

The following examples are intended to explain the invention, but without restricting it.

The specified components of the mixture were homogenised in the given weight ratios in screwed-down plastics containers in a dry-blend mixer for 30 minutes. According to need, there also took place tablet production and granulated-material production by breaking the molded bodies, or even, after addition of a binder, shaping by kneading and subsequent extrusion. The thermally initiable properties were characterized by establishing the detonation point or the calorific behavior by recording the thermo-gravimetry and differential thermal analysis. The detonation point was determined by heating 100 or 300 mg of a substance (depending on the liveliness of the reaction) to a maximum of 400° C. with a heating rate of 20° C. per minute. The temperature at which a significant reaction takes place with formation of gases or formation of flames, or even deflagration, is given as the detonation point.

EXAMPLES 1 to 24

Examples of thermal initiations as a function of the oxidizing agent:

| Components | | Mass ratios | Detonation point |
|---|---|---|---|
| calcium bistetrazolamine | | | 309° C. |
| calcium bistetrazolamine | zinc peroxide | 2:1 | 264° C. |
| calcium bistetrazolamine | zinc peroxide | 1:1 | 247° C. |
| calcium bistetrazolamine | zinc peroxide | 1:2 | 240° C. |
| calcium bistetrazolamine | sodium nitrate | 2:1 | >400° C. |
| calcium bistetrazolamine | sodium nitrate | 1:1 | >400° C. |
| calcium bistetrazolamine | sodium nitrate | 1:2 | >400° C. |
| 3-nitro-1,2,4-triazol-5-one | | | 260° C. |
| 3-nitro-1,2,4-triazol-5-one | strontium nitrate | 2:1 | 211° C. |
| 3-nitro-1,2,4-triazol-5-one | strontium nitrate | 1:1 | 243° C. |
| 3-nitro-1,2,4-triazol-5-one | strontium nitrate | 1:2 | 247° C. |
| 3-nitro-1,2,4-triazol-5-one | ammonium nitrate | 2:1 | 187° C. |
| 3-nitro-1,2,4-triazol-5-one | ammonium nitrate | 1:1 | 184° C. |
| 3-nitro-1,2,4-triazol-5-one | ammonium nitrate | 1:2 | 192° C. |
| 3-nitro-1,2,4-triazol-5-one | zinc peroxide | 2:1 | 251° C. |
| 3-nitro-1,2,4-triazol-5-one | zinc peroxide | 1:1 | 239° C. |
| 3-nitro-1,2,4-triazol-5-one | zinc peroxide | 1:2 | 235° C. |
| 3-nitro-1,2,4-triazol-5-one | potassium perchlorate | 2:1 | 244° C. |
| 3-nitro-1,2,4-triazol-5-one | potassium perchlorate | 1:1 | 244° C. |
| 3-nitro-1,2,4-triazol-5-one | potassium perchlorate | 1:2 | 220° C. |
| 5-aminotetrazole nitrate | | | 166° C. |
| 5-aminotetrazole nitrate | sodium nitrate | 1:0.46 | 166° C. |
| 5-aminotetrazole nitrate | iron(III)oxide | 1:1 | 195° C. |
| 5-aminotetrazole nitrate | iron(III)oxide/ boron nitride* | 1: 1/0.1 | 162° C. |

(* = boron nitride as impurity)

EXAMPLES 25 to 37

Examples of thermal initiations as a function of oxidizable components:

| Components | | Mass ratios | Detonation point |
|---|---|---|---|
| sodium nitrate | 3-nitro-1,2,4-triazol-5-one | 2:1 | 200° C. |
| sodium nitrate | 3-nitro-1,2,4-triazol-5-one | 1:1 | 200° C. |
| sodium nitrate | 3-nitro-1,2,4-triazol-5-one | 1:2 | 185° C. |
| sodium nitrate | 3-nitro-1,2,4-triazol-5-one | 1:4 | 196° C. |
| sodium nitrate | 3-nitro-1,2,4-triazol-5-one | 1:6 | 185° C. |
| | nitroguanidine | | 232° C. |
| sodium nitrate | nitroguanidine | 1:2 | >400° C. |

-continued

| Components | | Mass ratios | Detonation point |
|---|---|---|---|
| sodium nitrate | nitroguanidine | 1:1 | >400° C. |
| sodium nitrate | nitroguanidine | 2:1 | >400° C. |
| | bistetrazolamine | | 229° C. |
| sodium nitrate | bistetrazolamine | 1:2 | 228° C. |
| sodium nitrate | bistetrazolamine | 1:1 | 225° C. |
| sodium nitrate | bistetrazolamine | 2:1 | 220° C. |

EXAMPLES 38 to 47

Examples of the thermal initiation of mixtures which contain a plurality of components (for example also as binders) or vary in terms of the selection of oxidizing agents:

(Amounts in % by weight)

| ditetrazole ammonium nitrate | ammonium nitrate | binder | detonation point |
|---|---|---|---|
| 66.7 | 22.2 | 11.1 NPE | none |
| 66.7 | 22.2 | 11.1 PNP | 298° C. |

| nitro-guanidine | boron nitride | iron (III) oxide | zinc peroxide | potassium per-chlorate | sodium nitrate | detonation point |
|---|---|---|---|---|---|---|
| 20 | 4 | 38 | 38 | — | — | 188° C. |
| 20 | 4 | 40 | 31 | 5 | — | 234° C. |
| 20 | 2 | 40 | 30 | 4 | 4 | 203° C. |

| | Mass ratios | | | | |
|---|---|---|---|---|---|
| 3-nitro-1,2,4-triazol-5-one | 40 | 40 | 40 | 34 | 39.5 |
| guanidine nitrate | 40 | 39.5 | 39.5 | 34 | 39.5 |
| sodium nitrate | 20 | 20 | — | 30 | — |
| potassium nitrate | — | — | 20 | — | — |
| potassium perchlorate | — | — | — | — | 20 |
| graphite | — | 0.5 | 0.5 | 0.5 | — |
| boron nitride | — | | — | — | 1 |
| titanium | — | — | — | 1.5 | — |
| detonation point | 162° C. | 155° C. | 155° C. | 155° C. | 150° C. |

EXAMPLES 48 to 51

Example of the thermal initiability of a pyrotechnic mixture of 5-aminotetrazole, guanidine nitrate, sodium nitrate, graphite and an additive in the mass ratio 19.8:28.5:49.2:0.5:2, as a function of the type of additive:

| pyrotechnic mixture | admixture | detonation point |
|---|---|---|
| " | titanium | >400° C. |
| " | boron | >400° C. |
| " | ferrocene | 273° C. |
| " | iron(II)oxalate dihydrate | 245° C. |

EXAMPLES 52 to 56

Example of the thermal initiability of a pyrotechnic mixture as a function of the amount of the additive iron(II) oxalate dihydrate:

| 5-aminotetrazole | sodium nitrate | iron(II)oxalate dihydrate | detonation point |
|---|---|---|---|
| 49.9 | 49.9 | 0.2 | >400° C. |
| 49.7 | 49.7 | 0.6 | >400° C. |
| 49.3 | 49.3 | 1.4 | 250° C. |
| 48.5 | 48.5 | 3.0 | 251° C. |
| 47 | 47 | 6.0 | 245° C. |

What is claimed is:

1. A composition for producing gas in a gas generator, consisting of a) a gas-generating mixture and b) substances or mixtures of substances which have lower detonation points or decomposition points than the gas generating mixture and thermally decompose exothermically in a narrowly limited temperature range, the evolution of heat igniting the gas-generating mixture, said substance or substances being hereinafter called the temperature fuse, characterized in that the temperature fuse contains a compound selected from the group consisting of iron oxide and ferrocene, and a compound selected from the group consisting of oxalates, peroxodisulfates (persulfates), permanganates, nitrides, perborates, bismuthates, formates, nitrates, sulfamates, bromates or peroxides.

2. The composition of claim 1, wherein the a compound selected from the group consisting of oxalates, peroxodisulfates (persulfates), permanganates, nitrides, perborates, bismuthates, formates, nitrates, sulfamates, bromates or peroxides is a compound selected from the group consisting of iron(II) oxalate dihydrate with a sharp decomposition point starting at 190° C., ammonium iron- (III)oxalate, the double salt of ammonium oxalate, iron oxalate with decomposition temperatures of 160–170° C., ammonium persulfate, sodium persulfate, potassium persulfate, sodium permanganate, potassium permanganate, ammonium formate, calcium formate, ammonium nitrate, ammonium sulfamate, iron nitride, sodium bismutate, potassium bromate, zinc peroxide and combinations thereof.

3. The composition of claim 1, wherein the temperature fuse further comprises at least one oxidizable component.

4. The composition as claimed in claim 3, wherein the oxidizable component is an explosive chosen from explosives with low detonation or decomposition points.

5. The composition of claim 1, wherein the explosive is selected from the group consisting of calcium-bistetrazole-amine, 3-nitro-1,2,4-triazole-5-one (NTO), 5-aminotetrazole nitrate, nitroguanidine (NIGU) and bistetrazole amine.

6. The composition of claim 1, wherein the temperature fuse further contains at least one fuel.

7. The composition of claim 1, wherein the temperature fuse further contains at least one reducing agent.

8. The composition of claim 1, wherein the fuel is at least one explosive.

9. The composition of claim 8, wherein the explosive is selected from the group consisting of calcium-bistetrazole-amine, 3-nitro-1,2,4-triazole-5-one (NTO), 5-aminotetrazole, nitrate, nitroguanidine (NIGU) and bistetrazole amine.

10. The composition of claim 7, wherein the reducing agent is at least one metal powder.

11. The composition of claim 10, wherein the metal powder is titanium powder.

12. The composition of claim 1, wherein the temperature fuse contains at least one explosive selected from the group consisting of calcium-bistetrazole-amine, 3-nitro-1,2,4-triazole-5-one (NTO), 5-aminotetrazole nitrate, nitroguanidine (NIGU) and bistetrazole amine and at least one oxidizing agent selected from the group consisting of zinc peroxide, ammonium nitrate, potassium nitrate, sodium nitrate, strontium nitrate, potassium perchlorate and mixtures thereof.

13. The composition of claim 1, wherein the temperature fuse additionally contains as the reducing agent at least one metal powder.

14. The composition as claimed in claim 12, wherein the temperature fuse additionally contains as the reducing agent titanium powder.

15. The composition of claim 1, wherein the temperature fuse is present in a homogeneous mixture with the gas generating mixture.

16. The composition of claim 1, wherein the temperature fuse is present separately from the gas generating mixture.

17. The composition of claim 1, wherein the temperature fuse is integrated in the ignition means for the gas generating mixture.

18. The composition of claim 1, wherein the temperature fuse comprises 0.1 to 20% by weight of the gas generating mixture.

19. The composition of claim 1, wherein the temperature fuse comprises 0.1 to 5% by weight of the gas generating mixture.

20. A motor vehicle safety system including a gas generator, wherein the gas generator includes a composition of claim 1.

21. A pressure or safety element including a gas generator, wherein the gas generator includes a composition of claim 1.

* * * * *